US006120317A

United States Patent [19]

Miquet

[11] Patent Number: 6,120,317

[45] Date of Patent: Sep. 19, 2000

[54] CONNECTION/DISCONNECTION MODULE FOR CONNECTING AND DISCONNECTING PAIRS OF INSULATED ELECTRIC CONDUCTORS

[75] Inventor: Pascal Miquet, Tournes, France

[73] Assignee: Alcatel, Paris, France

[21] Appl. No.: 09/287,287

[22] Filed: Apr. 7, 1999

[30] Foreign Application Priority Data

Apr. 9, 1998 [FR] France ..... 98 04433

[51] Int. Cl.[7] ..... H01R 4/24

[52] U.S. Cl. ..... 439/417; 439/922

[58] Field of Search ..... 439/417, 418, 439/413, 412, 404, 732, 922

[56] References Cited

U.S. PATENT DOCUMENTS 5,564,950 10/1996 Loman et al. ..... 439/417

FOREIGN PATENT DOCUMENTS 2 275 312-A1 4/1996 France .

2 261 773 5/1993 United Kingdom .

*Primary Examiner*—Neil Abrams

*Assistant Examiner*—Hae Moon Hyeon

*Attorney, Agent, or Firm*—Sughrue, Mion, Zinn, Macpeak & Seas, PLLC

[57] ABSTRACT

The connection/disconnection module includes an insulating support and two first and two second insulation-displacement contacts that can be plugged into one another. It includes firstly two connectors, each of which comprises the two first contacts or the two second contacts, and a pusher moveably mounted on the two contacts, and secondly the support comprising a base and a connection block projecting from the base for the purpose of connecting the connectors to said block and to each other.

16 Claims, 5 Drawing Sheets

CONNECTION/DISCONNECTION MODULE FOR CONNECTING AND DISCONNECTING PAIRS OF INSULATED ELECTRIC CONDUCTORS

The present invention relates to a connection/disconnection module for connecting and disconnecting pairs of insulated electric conductors. Such modules are in particular designed to make up assemblies for connecting together and cross-connecting pairs of conductors.

BACKGROUND OF THE INVENTION

Document EP-A-0 248 743 discloses a modular connection device for connecting together pairs of insulated conductors. That device comprises an insulating support, two extender stacks of tubular contacts in the support, guide means making it possible for each contact to be displaced axially but not angularly relative to the support, and an actuating screw for driving two side-by-side contacts in translation relative to the support.

In that known device, all of the contacts are identical. Both of the ends of each of them are insulation-displacement ends so that a conductor can be connected to one of the insulation-displacement ends, and one of the ends of each of the contacts can be plugged into the other end of another contact in each stack.

The support is provided with sockets which can themselves be plugged together, which are retained on a metal stand connected to ground, and which retain the two stacks of contacts internally between them. Passageways are provided in the sockets facing the insulation-displacement ends of the contacts. They receive the electric conductors which are connected to the insulation-displacement ends by simultaneously displacing the side-by-side contacts relative to one of the sockets, by actuating the screw then anchored in the stand.

The stacked contacts may also be unplugged by actuating the screw and removing it from the stand, thereby unplugging the previously stacked contacts.

That known device may also be provided with a surge arrester for protecting equipment connected to the electric conductors. The surge arrester is removably mounted on an intermediate socket in the stack of sockets. It has two line-protection terminals connected to the top contacts in the two stacks of contacts, and a ground terminal electrically connected to the screw which is organized to be conductive.

Such a connection/disconnection device is relatively complex both in terms of the number of independent parts mounted separately from one another and also in terms of the resulting assembly/disassembly operations and the length of time required to connect together/disconnect pairs of conductors.

OBJECTS AND SUMMARY OF THE INVENTION

An object of the present invention is to provide a connection/disconnection module for connecting and disconnecting pairs of conductors, which module is of simplified design and is simple to use, and is therefore low cost.

The present invention provides a connection/disconnection module for connecting and disconnecting pairs of electric conductors, the module including an insulating support and two first and two second insulation-displacement contacts that can be plugged partially into one another, said module including:

two connectors that can be plugged partially into each other and that can be unplugged from each other, a first one of said connectors being formed by said two first contacts and by a first insulating pusher mounted on said first contacts and retaining them side-by-side, and the second one of said connectors being formed by said second contacts and by a second insulating pusher mounted on said second contacts and retaining them side-by-side, the pusher of each of said connectors being moveably mounted on an insulation-displacement first end of each of the two contacts of the connector so as to move in one direction only towards the "plug-in" second end of each of the same contacts, thereby connecting one of the pairs of conductors to the insulation-displacement first ends of the two contacts of said connector; and said support comprising a base and a connection block, said block projecting from a connection face of said base and being provided with two internal side-by-side first receptacles, said first receptacles being parallel to said base and open on either side in two opposite side faces of said block, so that the plug-in second ends of the contacts of said first and second connectors can be plugged into said first receptacles, thereby plugging said connectors into each other via respective ones of the two opposite side faces of said block.

This module advantageously also has at least one of the following characteristics:

said first contacts are tubular contacts and said second contacts are flat contacts, the inside diameter of the second end of each of the first contacts and the width of the second end of each of the second contacts being substantially identical;

said second end of each of said first and second contacts is provided with at least one resilience-imparting slot;

said first pusher is provided with two identical and side-by-side first necks in which said first contacts are mounted, and with two identical and side-by-side second necks extending transversely to the first necks, opening out therein, and assigned to receiving respective ones of the two insulated conductors of one of said pairs of conductors.

said second pusher is provided with two identical deep grooves which are mutually parallel and side-by-side, and in which said second contacts are mounted, and with two passageways disposed side-by-side, extending transversely to the grooves, and opening out therein, for receiving respective ones of the two conductors of the other of the pairs;

the module also includes a modular surge arrester device that can be plugged into said block on that face thereof which is opposite from said base; and said block is provided with two identical second receptacles extending transversely to said first receptacles and opening out therein and in that face of the block which is opposite from said base, and with a middle third receptacle extending parallel to and disposed between said second receptacles, and opening out firstly through said base and secondly in the face opposite from the base of said block, and said block contains two third contacts mounted in respective ones of the second receptacles, and a ground contact mounted in said third receptacle and projecting from the base, from that face of the base which is opposite from said connection face.

BRIEF DESCRIPTION OF THE DRAWINGS

The characteristics and advantages of the invention appear from the following description of embodiments given by way of example in the accompanying drawings, in which.

MORE DETAILED DESCRIPTION

Figure 2:
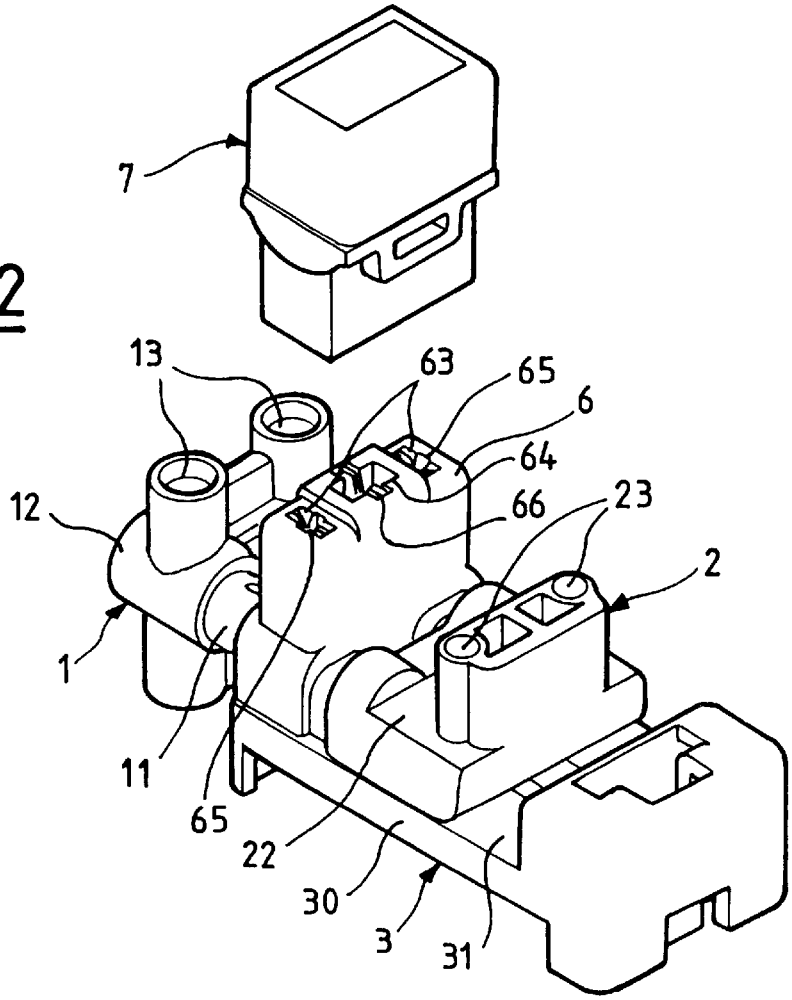
FIG. 2 is a perspective view of a connection/disconnection module of the invention, with protection associated with the module.
Figure 1:
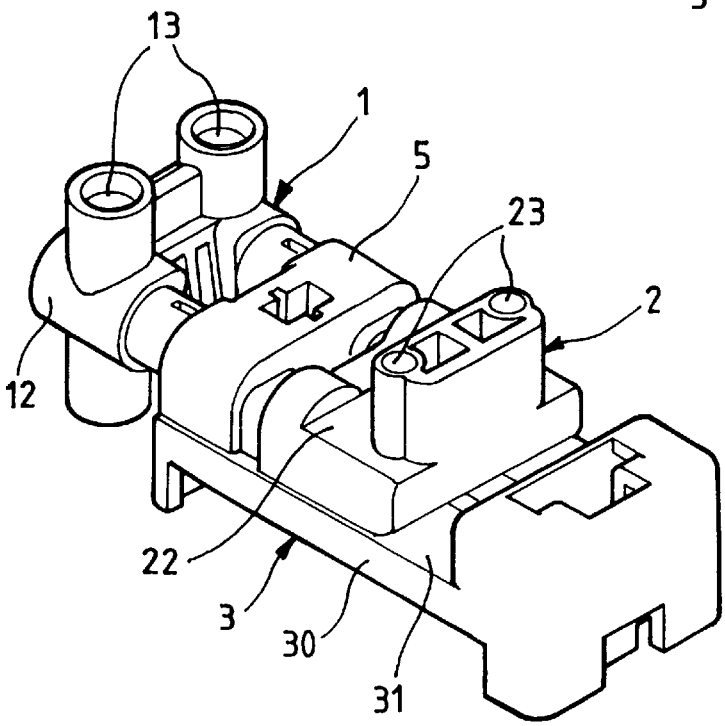
FIG. 1 is a perspective view of a connection/disconnection module of the invention without any protection associated with the module.

The connection/disconnection modules shown in FIGS. 1 and 2 are described simultaneously while specifying their essential differences with reference to these figures.

Each of the modules comprises two connectors 1 & 2 and an insulating support 3 on which the two connectors are mounted facing each other and plug into each other and into the support.

Each of the connectors 1 and 2 is assigned to connecting a respective pair of insulated electric conductors To this end, the connector 1 is provided both with two tubular first contacts that are identical to each other, that are not shown in FIGS. 1 and 2 but that are designated below by reference 11, and also with a first pusher 12 moveably mounted on first ends of the contacts. The pusher 12 holds the contacts side-by-side, and connects a first pair of conductors to the first ends of the contacts. It is provided with two passageways 13 extending transversely to the contacts and facing the first ends thereof, and serving to receive the conductors. In analogous manner, the second connector 2 is provided with two second contacts that are identical to each other but not to the first contacts, and that are not shown in FIGS. 1 and 2 but that are designated below by reference 21, and with a second pusher 22 moveably mounted on the first ends of these contacts. The second pusher holds the two second contacts side-by-side. It is provided with two passageways 23 extending transversely to the second contacts and situated facing the first ends thereof, and serving to connect a second pair of conductors inserted in these passageways to the second contacts.

The second ends of the two first contacts and of the two second contacts are the ends via which the connectors plug into each other.

The support 3 defines a base 30 that is rectangular in overall shape and that is provided with a transverse connection block projecting from a connection face 31 of the base. The block is designated by reference 5 in FIG. 1 and by reference 6 in FIG. 2. It is substantially rectangular block shaped, with block 6 projecting to a significantly larger extent than block 5. The block is provided on one of the end portions of the base. In a variant, the block may be provided elsewhere on the base, and optionally in the middle thereof.

The blocks 5 and 6 perform the common function of plugging the connectors 1 and 2 into each other. For this purpose, each of them is provided with two identical first internal receptacles that are not shown in FIGS. 1 and 2, but that are designated below by reference 61. The two first receptacles in each of the blocks are provided side-by-side, they are parallel to the base 30, and they open out on either side of the block on two opposite faces via which the connects 1 and 2 are plugged into the block.

The block 6 further makes it possible to perform an additional function of protecting equipment connected to the pairs of conductors interconnected by the connection/disconnection module shown in FIG. 2. For this purpose, it is provided with three additional receptacles, two of which are side receptacles 63 opening out into the first two receptacles and in that face of the block 6 which is opposite from the base, the third additional receptacle 64 being the middle one of the additional receptacles and opening out through the base 30 and also in that face of the block 6 which is opposite from the base. Two third contacts 65 are mounted in the two side receptacles 63, and a "ground" contact 66 is mounted in the middle receptacle 64.

The connection/disconnection module shown in FIG. 2 is provided with a three-pole surge arrester module 7 corresponding to the block 6 and which plugs into the block 6, thereby connecting itself to the two third contacts 65 and to the ground contact 66 in the block.

The modules shown in FIGS. 1 and 2 are described in more detail with reference more particularly to FIGS. 3 and 4 and/or 5 and 6 relating to the connection/disconnection module shown in FIG. 2, given that, apart from the configurations specific to the additional function of said module, the connection/disconnection modules shown in FIGS. 1 and 2 are otherwise identical to each other.

The two first contacts 11 of the first connector 1 are tubular, while the second contacts 21 of the second connector are flat.

The first end of each of the first contacts is provided with two opposite insulation-displacement slots 14. The opposite second end is also provided with two opposite slots 15 which do not serve to displace insulation but rather to impart resilience to this pluggable end.

The first end of each of the second contacts is provided with an insulation-displacement axial slot 24. The second end is provided with another axial slot 25 which does not serve to displace insulation but rather to impart resilience to this second end. The width of the second end of each second contact is substantially equal to the inside diameter of the second end of each first contact, so that they can be resiliently plugged together.

The first pusher 12 defines a body comprising two identical necks 17 which project side-by-side from a "front" end of the pusher, and which receive the first ends of the first contacts. Each of the necks is provided with a slot 17A which is superposed on one of the slots 15 in one of the contacts 11 and comes above the slot 25 in one of the contacts 21 when the connectors 1 and 2 are plugged into the block and into each other. The passageways 13 in the first pusher are defined by two other necks which project side-by-side from a "top" face of the pusher, 13A, and which serve to receive the two conductors to be connected simultaneously to the two first contacts in the first pusher 12. The necks **13*a* extend transversely to the necks 17** and they open out respectively therein. Each of the necks has only one open end (either the front end or the top end, depending on the neck), the other end being closed.

The second pusher 22 is provided with two grooves 27 which are internally deep and disposed side-by-side, which receive the first ends of the second contacts 21, and which open out into two recesses 28 in the "front" face of this pusher. It is also provided with two passageways 23 extending transversely to the grooves 27 and opening out therein, and serving to receive the two conductors to be connected to the insulation-displacement first ends of the contacts 21. Only the front ends of the grooves 27 and the top ends of the passageways 23 are open, the opposite ends being closed.

The first receptacles 61 via which the connectors 1 and 2 are plugged into the block 6 and into each other are cylindrical in shape and of inside diameter organized to enable the necks 17 to be plugged snugly into them. Each of the first receptacles is provided with a circular first opening 67 having the same diameter as them, and via which the corresponding neck 17 is inserted. Each of them is also provided with a suitable, rectangular, second opening 69 for receiving the plug-in second end of a respective one of the second contacts 21. Each of the second openings is provided with a peripheral lip 68 which is complementary to a respective one of the recesses 28 provided in the second pusher, and which engages therein.

The two side contacts 65 in the block are straight, flat contacts. The innermost end of each of the contacts in the block forms a tab 65A which slides in the slot 17A in one of the necks 17, in the slots 15 in one of the contacts 11, and in the slot 25 in one of the contacts 21 when the connectors 1 and 2 are plugged into the block and into each other. The "top" other end of each of the contacts is provided with an axial slot 65B for resiliently clamping the corresponding line tab of the surge arrester that plugs into this slot The ground contact 66 in the block is also a flat contact, it is longer than the contacts 65 but it is not straight. It has an end portion which is cut to a U shape, which projects under the base, and whose end branch forms a rubbing spring 66A. The end rubbing spring 66A is substantially parallel to the base 30 and at a relatively small distance therefrom. The other end of the ground contact 66 is provided with an axial slot 66B into which the ground tab of the surge arrester is plugged.

The surge arrester module that can be plugged into the block and that is shown in FIG. 2 is not shown in the other figures. Nevertheless, it is easy to understand that the bottom face of this module is provided with a recess which is of shape complementary to the shape of the block, and in which the two line tabs and the ground tab of the surge arrester project so that the surge arrester engages over the block with its line tabs and its ground tab plugging respectively into the two contacts 65 and into the contact 66.

Figure 3:
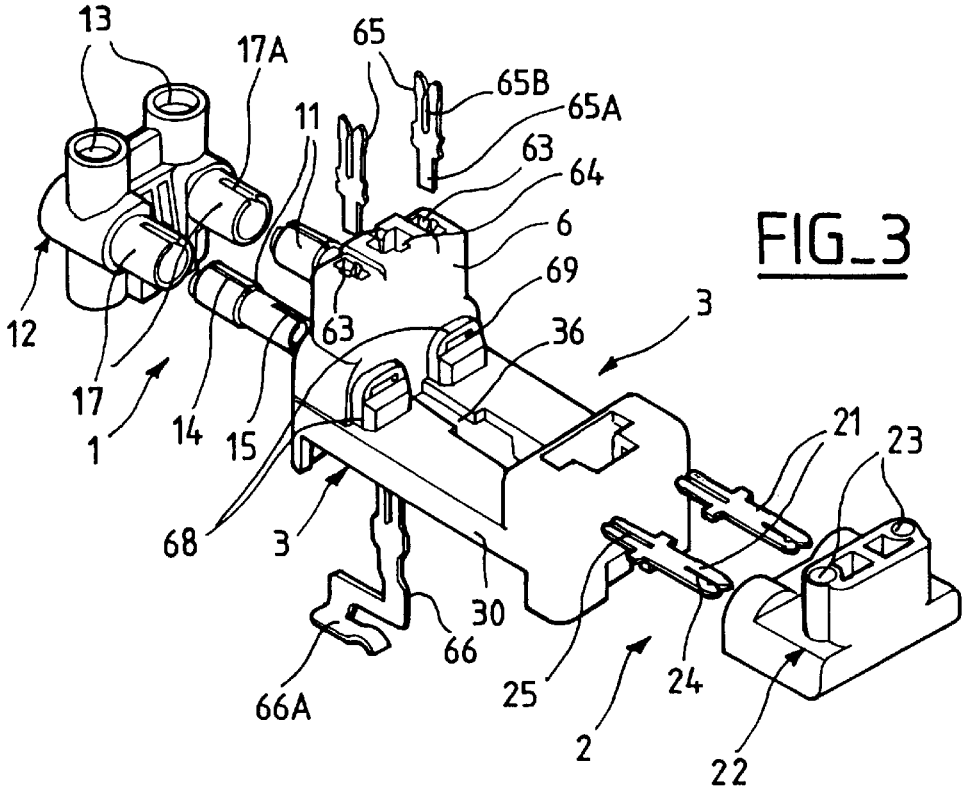
FIGS. 3 and 4 are exploded perspective views, respectively from above and from below, of the module shown in FIG. 2.
Figure 4:
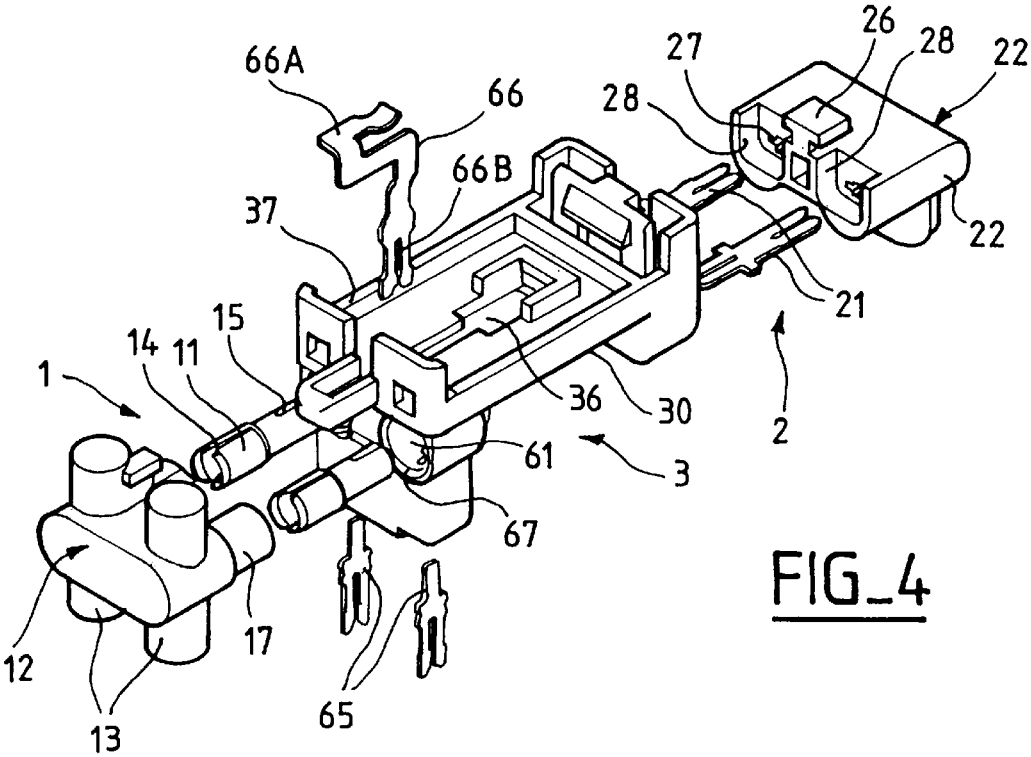
Figure 5:
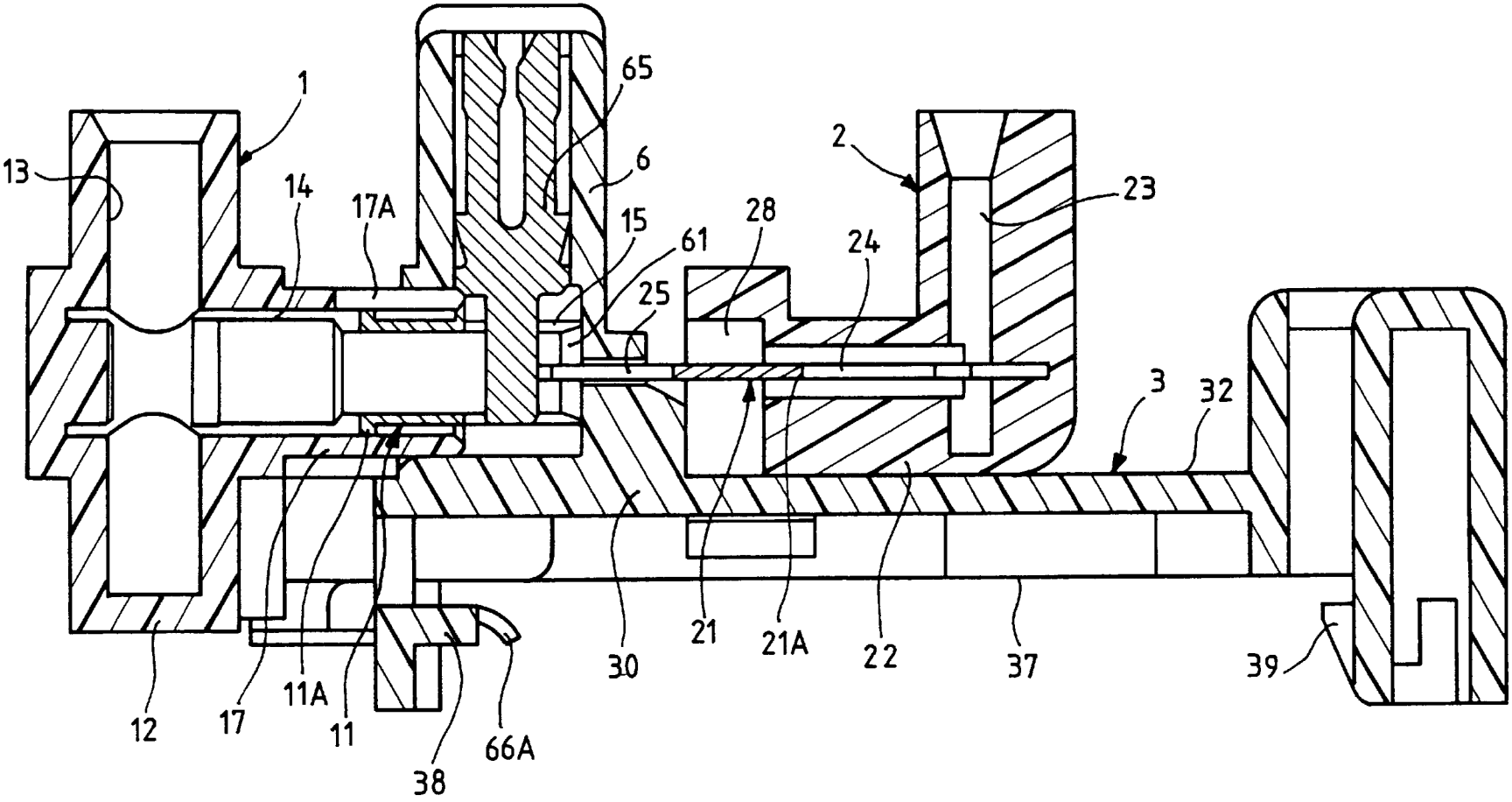
FIGS. 5 and 6 are section views of the module shown in FIG. 2.

With reference more particularly to FIGS. 3, 4, or 5, it can be seen that the base 30 serves as a slideway for the connector 2. For this purpose, the base 30 is provided with an axial slot 36 that is relatively narrow in its portion situated in the vicinity of the block 6, and that is wider in its opposite portion. The pusher 22 is provided with a corresponding tongue 26 provided with a shoulder so that the pusher can be slidably mounted on the base. The tongue is inserted via the wide portion of the slot 36 and it is retained and guided along the narrow portion thereof.

In addition, and as shown in particular in FIGS. 4 and 5, the support 3 is equipped so that it can be removably mounted on a rail for holding and assembling together identical connection/disconnection modules side-by-side. Peripheral lips project from under the base. The longitudinal lips 37, which are truncated heightwise relative to the transverse lips, and a transverse catch 38 secured to the transverse lip situated under the block 6 serve to abut against the rail on either side thereof. A resilient catch 39 secured to the other transverse lip and opposite from the catch 38 serves to fix the support 3 and thus the connection/disconnection module to the rail. It can be retracted by means of a screwdriver or the like for unhooking the connection/disconnection module at will. The rail is a standard metal rail, in particular a "DIN35" rail against which the end rubbing spring 66A of the ground contact bears resiliently.

Figure 6:
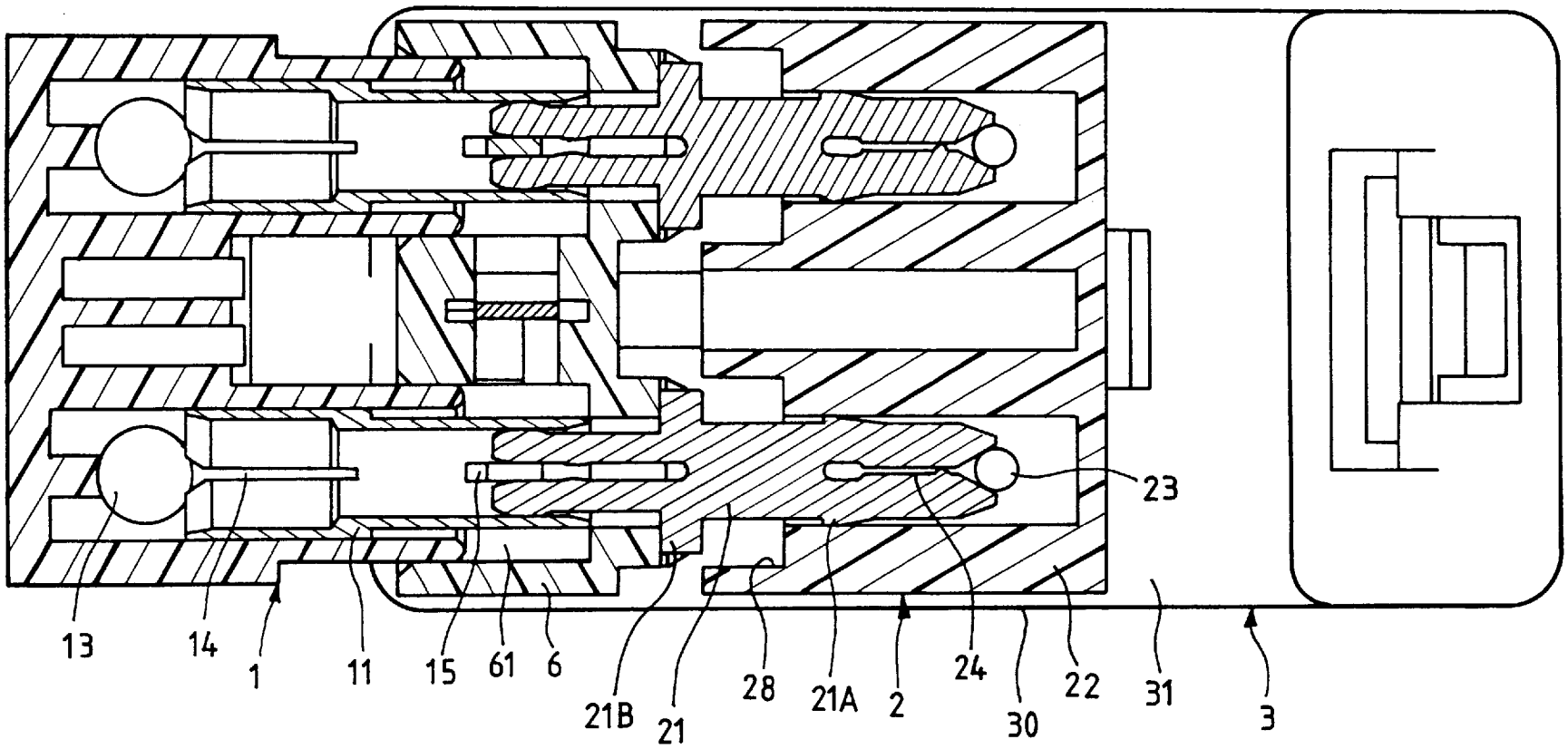

FIGS. 5 and 6 shows the connection/disconnection module with the connectors 1 and 2 in initial positions on the base 30 of the support 3, the pushers 12 and 22 themselves being in initial positions on their respective contacts 11 and 21.

It should be noted that, when each of the pushers is in the initial position on its two contacts, the two passageways 13 or 23 of the pusher are situated just at the end of the insulation-displacement slots 14 or 24 of the contacts 11 and 21, and they are therefore not closed off by the contacts. It should also be noted that each of the pushers can be moved in a single direction only over its two contacts from its initial position to a final position. When the pusher is in the final position, the passageways 13 or 23 are closed by the relevant contacts.

A small peripheral shoulder 11A on the intermediate portion of each of the contacts 11, and two small side teeth 21A on the intermediate portion of each of the contacts 21 enable the contacts to be held stable in their pushers, and allow each of the pushers to be displaced on the contacts in one direction only.

In addition, two wide side teeth 21B on each of the flat contacts 21 are provided substantially at the same level as the end wall of its resilience-imparting slot 25. They make it possible firstly to stop the flat contacts 21 in their receptacles 61 in the block 5 by the teeth 21B abutting against the edge of the rectangular openings 69 of these receptacles. They also make it possible to stop the pusher 22 in its final position on the flat contacts by the end walls of the recesses 27 abutting against the teeth, while the pusher 22 itself comes into abutment against the block 6.

The mode of operation for connecting/disconnecting two pairs of insulated conductors is described in detail with reference more particularly to FIGS. 5 and 6. The pairs of conductors are connected together in two stages using pliers, by driving the two pushers one after the other from their initial positions to their final positions on their contacts, thereby plugging together the two connectors.

In a first stage, the first connector 1 is removed partially or totally from the support 3 so that the second connector 2 can be connected to that one of the pairs of conductors which is assigned to it. Such partial or total removal of the first connector 1 is achieved by pulling on the pusher 12 which entrains its two tubular contacts with it. It thus makes it possible to release the corresponding face of the block sufficiently or totally so that one of the jaws of the pliers can be pressed against this face, while the other jaw presses against the back face of the pusher 22. The two conductor wires are inserted into respective ones of the two passageways 23 of the pusher 22. The pliers as placed such as to clamp the pusher 22 and the block 6 between their jaws thus drive the pusher 22 into its final position on its two contacts 21 which are themselves then in their final positions in the receptacles 61 in the block 6. The resulting connection of the two conductors in the insulation-displacement slots 24 in the contacts 21 is then permanent.

In a second stage, the two insulated conductors of the other pair are inserted into the two passageways 13 in the pusher 12 of the first connector 1, this first connector being partially plugged into the block 6 either after or before the conductors are inserted into the passageways 13. The first pusher 12 is then driven to its final position on the tubular contacts 11 by means of the pliers whose jaws clamp the pusher 12 and the block 6 or the pusher 22 between them. As a result, firstly the contacts 11 are plugged fully into the receptacles 21 in the block and into the contacts 61 already in their final positions therein. Secondly, the necks 17 are plugged fully into, i.e. to the end walls of, the receptacles 61, while at the same time the two conductors are engaged in the insulation-displacement slots 14 of the contacts 11. The two conductors are thus also connected to the two contacts 11 permanently.

The two pairs of conductors connected to the connectors 1 and 2 are connected together as a result of the two connectors being plugged into each other inside the block 6. For the purposes of interrupting the lines connected in this way, the two pairs of conductors can be disconnected by unplugging the connectors, by means of a screwdriver or the like actuated as a lever, or even my means of a finger, so as to separate one or both of the connectors from the block 6. A test operation can be performed in like manner by unplugging the connectors.

Protection against voltage surges is provided by the surge arrester module (FIG. 2) which is then plugged into the block 6.

The connections in the connection/disconnection module can also be protected against attack from the surrounding environment by using a grease and confining it in the module.

Advantageously, the pushers 12 and 13 are transparent to facilitate directly checking that the conductors are correctly connected to the contacts.

The simplified design of the connection/disconnection module which comprises a small number of parts that are pre-assembled to form the two connectors 1 and 2 which can be plugged into the support and thus into each other, makes the mode of operation very simple and easy, without any special member being integrated for this purpose in the module. It also reduces the cost of the module and the duration of the operation accordingly.

Figure 7:
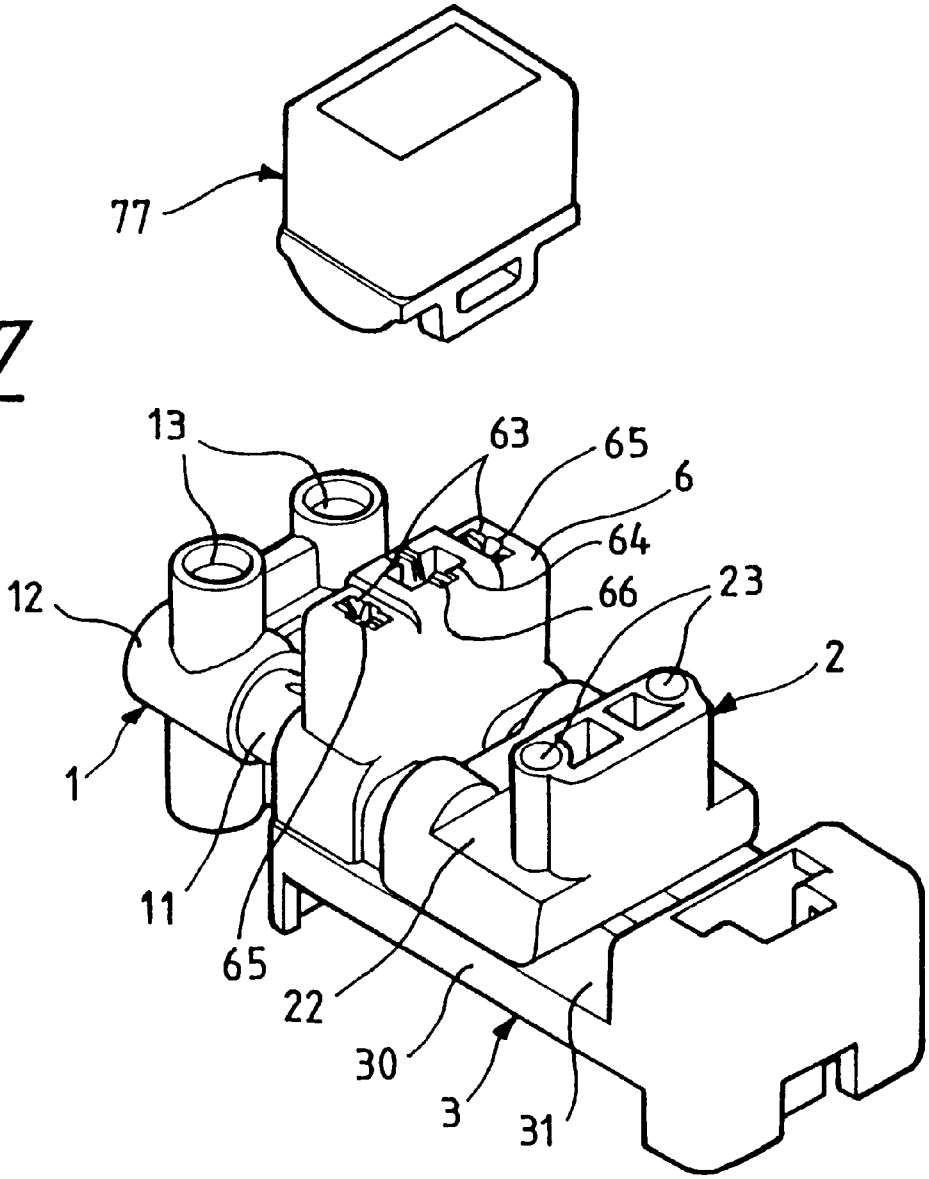
FIG. 7 is a perspective view of a connection/disconnection module similar to FIG. 2 but including a cover 77 in place of the surge arrester 7.

In a variant given relative to FIG. 1, the connection/disconnection module without associated protection comprises the two connectors 1 and 2 and the insulating support 3 of the module shown in FIG. 2, and a cover 77 which then replaces the surge arrester module 7, and which is used to cover the block 6. Such a connection/disconnection module may be as shown in FIG. 7 and may optionally be provided with the two contacts 65 and the ground contact 66 in the block 6. Such a cover 77 may be of shape analogous to the shape of the surge arrester module, or of simplified shape.

What is claimed is:

1. A connection/disconnection module for connecting and disconnecting pairs of electric conductors, the module including an insulating support and two first and two second insulation-displacement contacts that can be plugged partially into one another, said module including:

two connectors that can be plugged partially into each other and that can be unplugged from each other, a first one of said connectors being formed by said two first contacts and by a first insulating pusher mounted on said first contacts and retaining them side-by-side, and the second one of said connectors being formed by said second contacts and by a second insulating pusher mounted on said second contacts and retaining them side-by-side, the pusher of each of said connectors being moveably mounted on an insulation-displacement first end of each of the two contacts of the connector so as to move in one direction only towards the "plug-in" second end of each of the same contacts, thereby connecting one of the pairs of conductors to the insulation-displacement first ends of the two contacts of said connector; and said support comprising a base and a connection block, said block projecting from a connection face of said base and being provided with two internal side-by-side first receptacles, said first receptacles being parallel to said base and open on either side in two opposite side faces of said block, so that the plug-in second ends of the contacts of said first and second connectors can be plugged into said first receptacles, thereby plugging said connectors into each other via respective ones of the two opposite side faces of said block.

2. A module according to claim 1, wherein said first contacts are tubular contacts and said second contacts are flat contacts, the inside diameter of the second end of each of the first contacts and the width of the second end of each of the second contacts being substantially identical.

3. A module according to claim 2, wherein the second end of each of said first and second contacts is provided with at least one resilience-imparting slot.

4. A module according to claim 1, wherein said first and second contacts are provided with anchoring means disposed on an intermediate portion of each of them, and allowing each of said pushers to be displaced only from an initial position to said final position.

5. A module according to claim 3, wherein each of said first receptacles is provided with a circular first opening and with a rectangular second opening in respective ones of said two opposite side faces of said block.

6. A module according to claim 5, wherein said first pusher is provided with two identical and side-by-side first necks in which said first contacts are mounted, and with two identical and side-by-side second necks extending transversely to the first necks, opening out therein, and assigned to receiving respective ones of the two insulated conductors of one of said pairs of conductors.

7. A module according to claim 6, wherein each of said first necks is provided with at least one end slot and has an outside diameter substantially equal to the diameter of said circular first opening in each said first receptacles so that it can be plugged into a respective one of said first receptacles.

8. A module according to claim 5, wherein said second pusher is provided with two identical deep grooves which are mutually parallel and side-by-side, and in which said second contacts are mounted, and with two passageways disposed side-by-side, extending transversely to the grooves, and opening out therein, for receiving respective ones of the two conductors of the other of the pairs.

9. A module according to claim 8, wherein complementary interfitting means are provided firstly around the second opening of each of said first receptacles in said block and secondly around the corresponding end of each of the grooves in said second pusher.

10. A module according to claim 8, wherein said base of said support, and at least said second pusher are provided with guide means for guiding said second pusher as it slides on said base.

11. A module according to claim 10, wherein said guide means comprise an axial guide slot in the base and a slide tongue on said second pusher.

12. A module according to claim 1, wherein said base is provided with catches on a face thereof opposite said block, for securing said base to a rail for supporting said base.

13. A module according to claim 1, including a cover that can be plugged onto said block to cover a face of said block which is opposite from said base.

14. A module according to claim 13, wherein said block is provided with two identical second receptacles extending transversely to said first receptacles and opening out therein and in that face of the block which is opposite from said base, and with a middle third receptacle extending parallel to and disposed between said second receptacles, and opening out firstly through said base and secondly in the face opposite from the base of said block, and said block contains two third contacts mounted in respective ones of the second receptacles, and a ground contact mounted in said third receptacle and projecting from the base, from that face of the base which is opposite from said connection face.

15. A module according to claim 14, wherein that portion of said ground contact which projects from the base forms an end rubbing piece for connecting to ground.

16. A module according to claim 1, further comprising a modular surge arrester pluggable into a face of said connection block opposite from said base.

* * * * *